US009677801B2

(12) United States Patent
Cho et al.

(10) Patent No.: US 9,677,801 B2
(45) Date of Patent: Jun. 13, 2017

(54) REFRIGERATOR

(71) Applicant: LG ELECTRONICS INC., Seoul (KR)

(72) Inventors: Yeonwoo Cho, Seoul (KR); Yanggyu Kim, Seoul (KR); Younseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 489 days.

(21) Appl. No.: 13/924,847

(22) Filed: Jun. 24, 2013

(65) Prior Publication Data

US 2013/0340463 A1 Dec. 26, 2013

(30) Foreign Application Priority Data

Jun. 22, 2012 (KR) ..... 10-2012-0067376

(51) Int. Cl.
*F25C 1/00* (2006.01)
*F25D 17/06* (2006.01)
*F25D 31/00* (2006.01)

(52) U.S. Cl.
CPC ..... *F25C 1/00* (2013.01); *F25D 17/065* (2013.01); *F25D 31/007* (2013.01); (Continued)

(58) Field of Classification Search
CPC ..... F25D 11/02; F25D 23/12; F25D 25/027; F25D 2317/061; F25D 17/065; F25D 2400/28; F25D 2400/30; F25C 1/10
See application file for complete search history.

(56) References Cited

U.S. PATENT DOCUMENTS 3,915,285 A * 10/1975 Lindquist et al. ..... 198/379
5,490,713 A 2/1996 Fukuoka
(Continued)

FOREIGN PATENT DOCUMENTS

CN 2797998 Y 7/2006
CN 1928469 A 3/2007
(Continued)

OTHER PUBLICATIONS

U.S. Office Action issued in co-pending U.S. Appl. No. 13/914,965 dated Jul. 29, 2015.
(Continued)

*Primary Examiner* — Pascal M Bui Pho
*Assistant Examiner* — Marcos O Diaz
(74) *Attorney, Agent, or Firm* — KED & Associates, LLP

(57) ABSTRACT

A refrigerator is provided, including a body having a refrigerator compartment and a freezer compartment positioned under the refrigerator compartment and separated by a mullion, and a cooling device provided at a lower portion of the refrigerator compartment, with a cold air passage guiding cold air to the cooling device. The cooling device may include a case having an open front surface, an agitating assembly disposed in the case and swinging about a rotational axis that is parallel with a longitudinal direction of the case, an agitating mechanism electrically or mechanically connected with the agitating assembly to swing the agitating assembly, a fan motor assembly mounted at a rear end of the case and supplying cold air into the case, and a cover selectively opening or closing the opened front surface of the case. An intake port and a discharge port of the cold air passage communicate with the freezer compartment.

5 Claims, 9 Drawing Sheets

(52) U.S. Cl.
CPC ..... *F25D 2317/061* (2013.01); *F25D 2317/0663* (2013.01); *F25D 2317/0666* (2013.01); *F25D 2317/0683* (2013.01); *F25D 2331/803* (2013.01); *F25D 2400/28* (2013.01)

(56) References Cited

U.S. PATENT DOCUMENTS

| | | | | |
|---|---|---|---|---|
| 6,082,114 | A | 7/2000 | Leonoff | |
| 2003/0209029 | A1 | 11/2003 | Lee et al. | |
| 2004/0144103 | A1 | 7/2004 | Lee et al. | |
| 2006/0185372 | A1* | 8/2006 | Conde Hinojosa | 62/64 |
| 2006/0260350 | A1 | 11/2006 | Van Meter et al. | |
| 2007/0098432 | A1 | 5/2007 | Mashiki | |
| 2007/0151284 | A1* | 7/2007 | Freesmeier et al. | 62/419 |
| 2007/0163289 | A1 | 7/2007 | Hahm et al. | |
| 2008/0134708 | A1* | 6/2008 | Lee et al. | 62/340 |
| 2009/0064686 | A1* | 3/2009 | Mohebbi et al. | 62/3.6 |
| 2009/0095865 | A1* | 4/2009 | Everhart et al. | 248/309.1 |
| 2010/0064719 | A1* | 3/2010 | Lee et al. | 62/419 |
| 2010/0072870 | A1* | 3/2010 | Hwang | F25D 23/025 312/405 |
| 2010/0139307 | A1* | 6/2010 | Kulkarni et al. | 62/407 |
| 2010/0180625 | A1* | 7/2010 | Lee | F25D 17/065 62/419 |
| 2010/0218542 | A1* | 9/2010 | McCollough | F25C 5/005 62/345 |
| 2011/0162405 | A1* | 7/2011 | Jeong | F25D 17/062 62/340 |
| 2012/0011884 | A1 | 1/2012 | Cho et al. | |
| 2012/0011885 | A1* | 1/2012 | Cho | F25D 17/065 62/426 |
| 2013/0017422 | A1 | 1/2013 | Bae et al. | |

FOREIGN PATENT DOCUMENTS

| | | | |
|---|---|---|---|
| CN | 1993589 | A | 7/2007 |
| CN | 101000199 | A | 7/2007 |
| CN | 101071033 | A | 11/2007 |
| CN | 101548143 | A | 9/2009 |
| CN | 101806525 | A | 8/2010 |
| JP | 2004-251560 | A | 9/2004 |
| JP | 2009-222244 | A | 10/2009 |
| KR | 10-2005-0041036 | A | 5/2005 |
| WO | WO 2012/008752 | A2 | 1/2012 |
| WO | WO 2012/008756 | A2 | 1/2012 |

OTHER PUBLICATIONS

European Search Report issued in Application No. 13173025.1 dated Mar. 7, 2016.
Chinese Office Action dated Apr. 1, 2015 issued in Application No. 201310232706.6 (with English translation).
United States Office Action dated Apr. 13, 2015 issued in U.S. Appl. No. 13/914,950.
Chinese Office Action dated Apr. 24, 2015 issued in Application No. 201310249954.1 (with English translation).

* cited by examiner

REFRIGERATOR

CROSS-REFERENCE TO RELATED APPLICATION(S)

This application claims priority under 35 U.S.C. §119 to Korean Application No. 10-2012-0067376 filed on Jun. 22, 2012, whose entire disclosure is hereby incorporated by reference.

BACKGROUND

1. Field

This relates to a refrigerator.

2. Background

Refrigerators may store items at low temperatures in storage spaces therein which are opened or closed by doors. Refrigerators may maintain items at an optimal status by cooling the inside of the storage space using cold air produced by heat exchange with a refrigerant circulating in a refrigeration cycle. Refrigerators having increased size and functionality consistent with changes in diet and the desire for additional convenience devices are becoming more prevalent.

BRIEF DESCRIPTION OF THE DRAWINGS

The embodiments will be described in detail with reference to the following drawings in which like reference numerals refer to like elements wherein.

DETAILED DESCRIPTION

In the following detailed description, reference is made to the accompanying drawings that form a part hereof, and in which is shown by way of illustration various exemplary embodiments. These embodiments are described in sufficient detail to enable those skilled in the art, and it is understood that other embodiments may be utilized and that logical structural, mechanical, electrical, and chemical changes may be made without departing from the spirit or scope as described herein. To avoid detail not necessary to enable those skilled in the art, the description may omit certain information known to those skilled in the art. The following detailed description is, therefore, not to be taken in a limiting sense.

A refrigerator may include an auxiliary cooling device for quickly chilling items, such as beverages, in a short time. Such a cooling device may use a suction fan to supply cold air to the cooling device and a channel structure for drawing in cold air from an evaporation chamber and discharging it to a freezer compartment. Depending on the arrangement of the various chambers and components, such a duct may be relatively large and long in order to cause the cold air in the evaporation chamber to flow all the way to an intake grill of the cooling device. In addition, if the cold air duct that guides the cold air in the evaporation chamber to the intake grill of the cooling device is exposed, for example, along the ceiling of other internal surface of the freezer compartment, condensation may accumulate on the exposed surface of the cold air duct.

Further, because the intake port and the discharge port of the cooling device are respectively connected to the evaporation chamber and the freezer compartment, a difference in pressure may be generated between the freezer compartment and the evaporation chamber when the freezer compartment fan operates. In this situation, the freezer compartment may be at positive pressure and the evaporation chamber may be at negative pressure, causing the cold air in the freezer compartment to flow into the cooling device due to a difference in pressure, even if the cooling device is not in operation. A damper may be disposed in the intake port or the discharge port of the cooling device to prevent this, but adds cost and complexity to the cooling device.

An auxiliary cooling device, or quick chiller, for a refrigerator, according to an embodiment as broadly described herein, may be mounted in a storage space of a refrigerator to perform quick chilling using cold air generated by the refrigerator.

Figure 1:
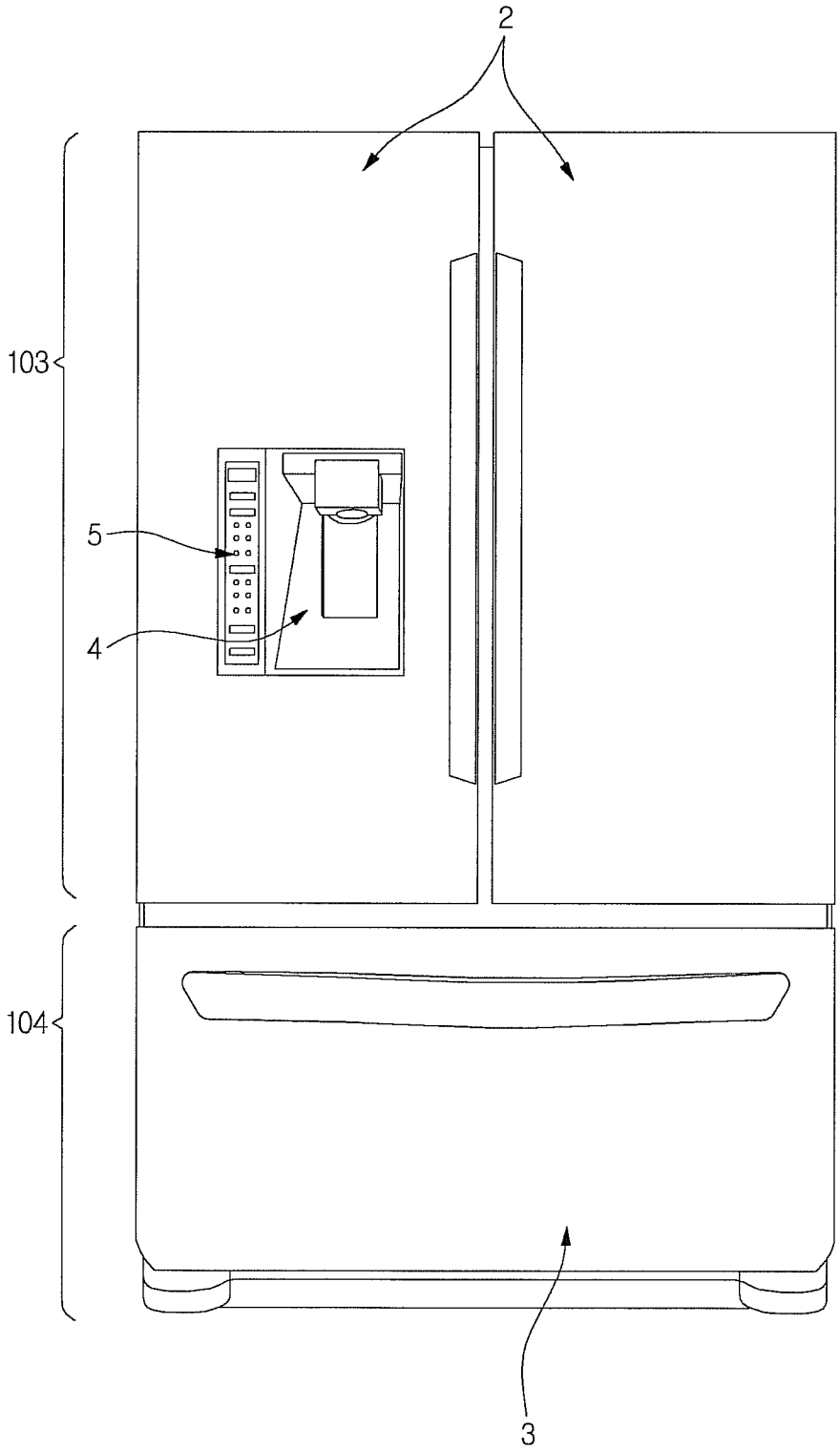
FIG. 1 is a front view of a refrigerator according to an embodiment as broadly described herein.
Figure 2:
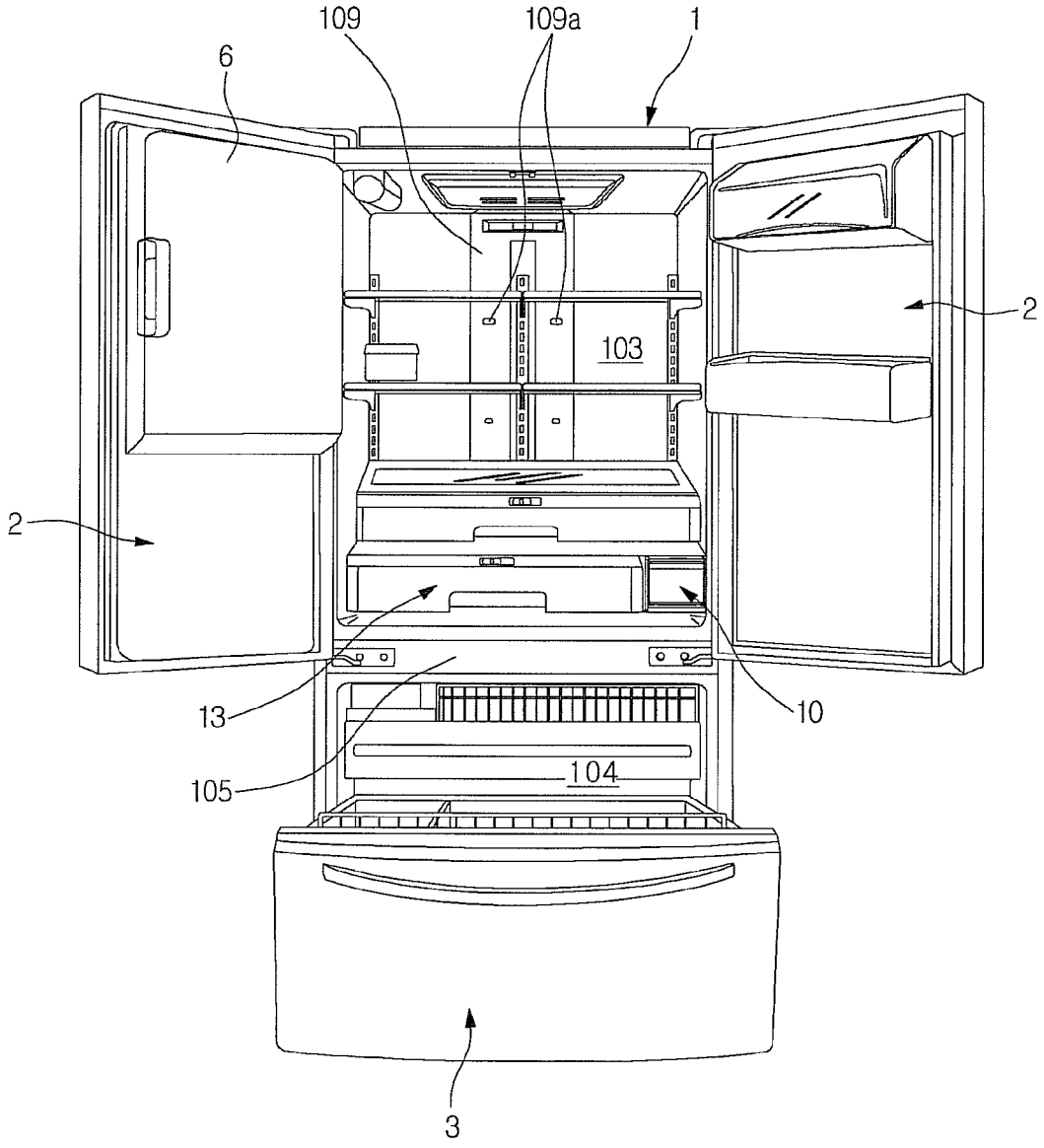
FIG. 2 is a front view of the refrigerator shown in FIG. 1, with doors open.
Figure 3:
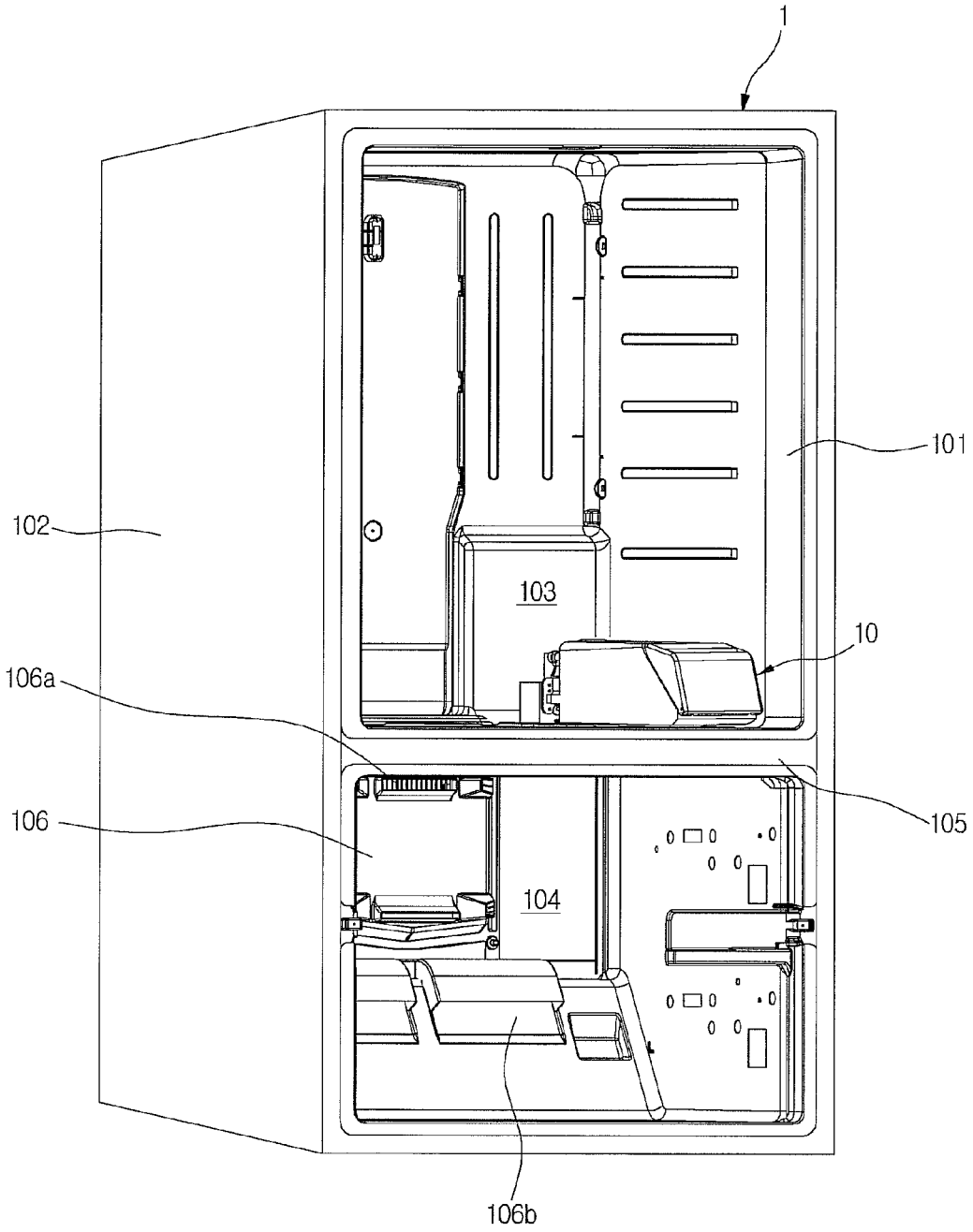
FIG. 3 is a rear perspective view showing the internal structure of the refrigerator shown in FIGS. 1 and 2.

Referring to FIGS. 1 to 3, the outer shape of a refrigerator as embodied and broadly described herein may be defined by a cabinet 1 with a refrigerator compartment 103 and a freezer compartment 104 formed therein and doors opening or closing the refrigerator compartment 103 and the freezer compartment 104. The cabinet 1 may include an outer case 102 forming the external appearance, an inner case 101 disposed inside the outer case 102 and having a storage space defined therein, and an insulator filled in between the inner case 101 and the outer case 102.

The storage space may include a refrigerator compartment 103 for keeping items cold and a freezer compartment 104 for keeping items frozen. The refrigerator compartment 103 may be opened or closed by a pair of storage doors 2 that opens or closes by pivoting, and the freezer compartment 104 may be opened or closed by a freezer door 3 that slides in/out. The present embodiment exemplifies a bottom freezer type refrigerator in which the storage space is divided horizontally by a separation wall 105 and the refrigerator compartment 103 is disposed over the freezer compartment 104.

However, in addition to the bottom freezer type refrigerator, the features described herein may also be applied in a top mount type refrigerator with a freezer compartment over a refrigerator compartment, a side-by-side type refrigerator with a freezer compartment and a refrigerator compartment disposed side by side, a refrigerator having only a refrigerator compartment, or a freezer having only a freezer compartment.

An evaporation chamber 107 (see FIGS. 8 and 9) may be formed at the rear of the freezer compartment 104 by an evaporation chamber wall 106 and an evaporator 108 may be disposed in the evaporation chamber 107. A cold air discharge port **106*a* through which cold air is discharged into the freezer compartment 104 and a cold air return port 106***b* through which the cold air in the freezer compartment 104 returns to the evaporation chamber 107 may be formed at the evaporation chamber wall 106. Therefore, the cold air in the freezer compartment 104 and the evaporator 107 may continuously cool the freezer compartment 104 while circulating through the cold air discharge port 106*a* and the cold air return port 106*b*.

A refrigerator compartment duct 109 may extend vertically along the rear wall of the refrigerator compartment 103 and communicate with the evaporator chamber 107. Cold air discharge ports 109*a* may be formed through the front of the refrigerator compartment duct 109 to discharge cold air into the refrigerator compartment 103 and a cold air return port may be formed at a top of the separation wall 105. Therefore, cold air may circulate through the duct 109, out through the cold air discharge ports 109*a* and back in through the cold air return port to continuously cool the refrigerator compartment 103.

An auxiliary cooling device 10 to quickly chill items such as beverages may be disposed on the top of the separation wall 105. The cooling device 10 may be independently mounted on the top of the separation wall 105 or may be combined with a drawer assembly 13 to be mounted on the separation wall 105 and then disposed as an assembly on the top of the separation wall 105. The cooling device 10 may maintain fluid communication with the evaporation chamber 107 and/or the freezer compartment 104 by channels connecting them. For example, cold air generated in the evaporation chamber 107 may be supplied to the cooling device 10 so that, for example, a beverage container received in the cooling device 10 for quick cooling may be cooled by the cold air supplied to the cooling device 10. The cold air having its temperature increased by heat exchange with the beverage container in the cooling device 10 may return to the evaporation chamber 107. Air may be circulated by a channel structure such as a duct between the evaporation chamber 107 and the cooling device 10. The container received in the cooling device 10, in accordance with embodiments as broadly described herein, may include all types of containers including bottles or cans filled with water, soft drinks, juice, alcohol and other such beverages. The cooling device 10 may include a chilling compartment defining the space where the container is received and/or and a cold air channel connecting the chilling compartment, the freezer compartment 104, and the evaporation chamber 107.

A dispenser 4 that allows ice made in an ice-making chamber 6 or purified water to be dispensed may be disposed on the front of one of the pair of storage doors 2. The dispenser 4 may include a display 5. The display 5 may be exposed on the front of the storage door 2, and may be disposed on a different storage door 2 than the dispenser 4.

The display 5, which may also allow for input of operating commands while displaying the operation status of the refrigerator, may include a combination of buttons and a screen, which may be configured to be operated by a touch.

The display 5 may display the operation status of the cooling device 10 or control the operation of the cooling device 10. That is, a user may rapidly cool containers by selecting the operation time or mode of the cooling device 10 as well as turning on/off the cooling device 10 by operating the display 5. Further, the display 5 may display the operation status of the cooling device 10, and when the cooling device 10 abnormally operates, the display 5 may inform the user of the abnormal operation.

Figure 4:
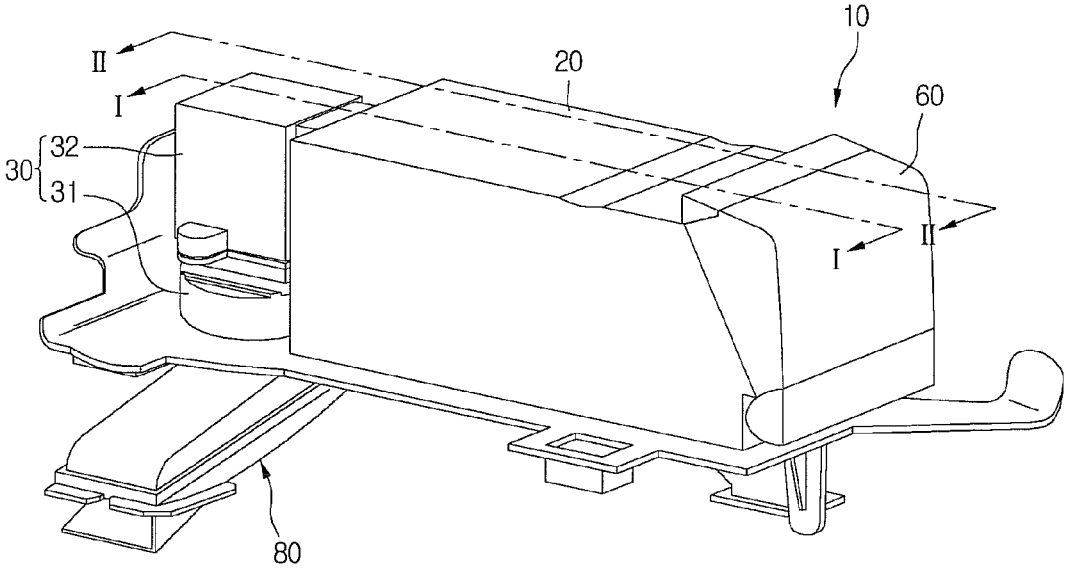
FIG. 4 is a perspective of a cooling device of a refrigerator, according to an embodiment as broadly described herein.
Figure 5:
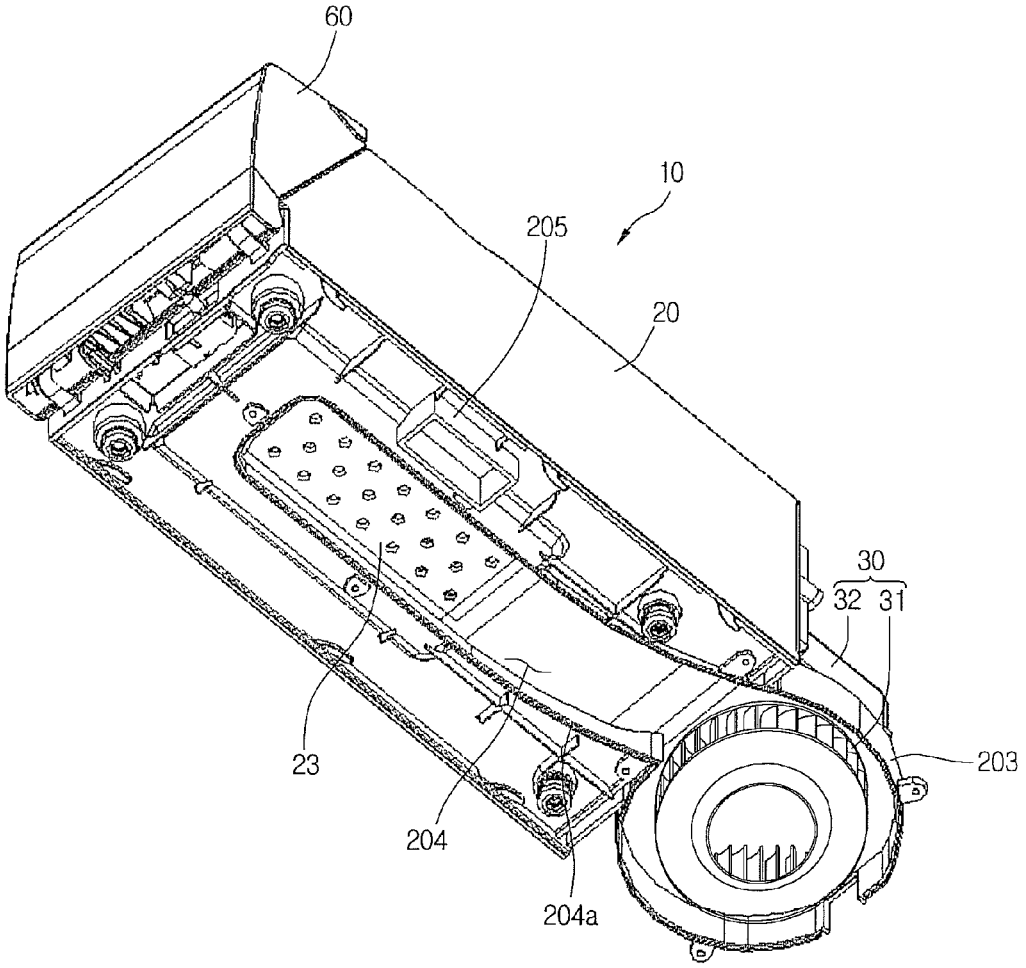
FIG. 5 is a bottom perspective view of the cooling device shown in FIG. 4.
Figure 6:
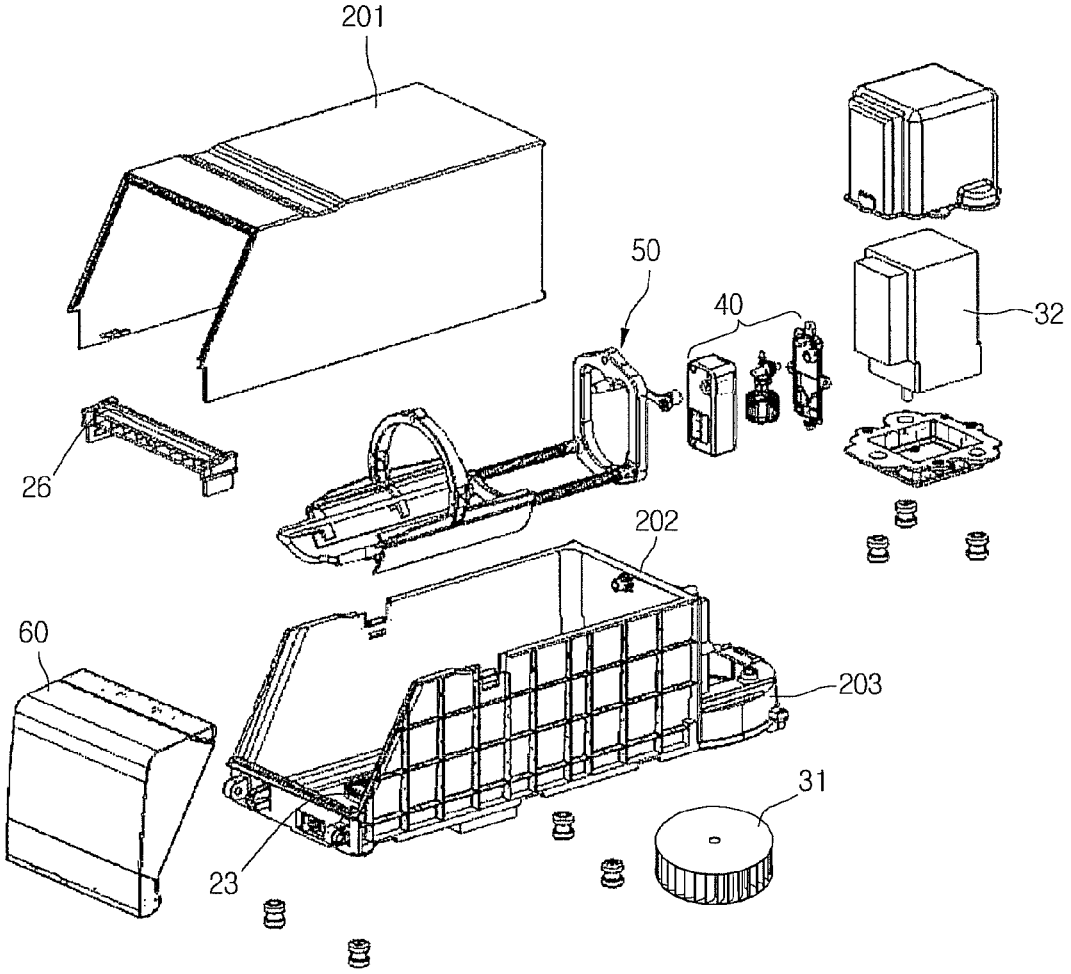
FIG. 6 is an exploded perspective view of the cooling device shown in FIG. 4.

FIG. 4 is a perspective view of a cooling device according to an embodiment as broadly described herein, FIG. 5 is a bottom perspective view of the cooling device, and FIG. 6 is an exploded perspective view of the cooling device.

Referring to FIGS. 4 to 6, the cooling device 10 may include an agitating assembly 50 configured to swing a container, a case 20 receiving the agitating assembly 50, a cover 60 selectively opening or closing a front opening of the case 20, a fan motor assembly 30 mounted at the rear end of the case 20 and supplying cold air, and an intake duct 80 mounted on the underside of the case 20.

In detail, the fan motor assembly 30 may include a blower type fan 31 that blows cold air into the case 20 and a motor 32 that drives the fan 31. A swing motor 40 that drives the agitating assembly 50 may be mounted at the rear of the case 20. A fan housing 203 may be formed on the underside of the rear end of the case 20 to receive the fan 31. A cold air supply passage 204 may extend to the front of the case 20 from the fan housing 203. The cold air supply passage 204 may be defined by a guide rib 204*a* and a guide cover 204*b* (see FIG. 8) that covers the guide rib 204*a*. The guide cover 204*b* may include a shroud 204*c* covering the fan housing 203, together with the guide cover 204*b*, and taking in cold air. A discharge port 205 may be formed at the underside of the case 20 to allow the cold air flowing in the case 20 through the cold air supply passage 204 to be discharged. The discharge port 205, as shown in the figures, may be formed at a side of the cold air supply passage 204 or may be formed at the front of the cold air supply passage 204.

An intake grill 23 may be mounted on the underside of the case 20, at an area corresponding to the front of the cold air supply passage 204. The intake grill 23 may be detachably coupled to the underside of the case 20 and a plurality of cold air holes may be arranged at the intake grill 23, such that the cold air hits against the surface of a container received therein at a relatively high pressure while passing through the cold air holes.

The case 20 may include a lower case 202 and an upper case 201 covering the lower case 202, and the fan housing 203, the cold air supply passage 204, and the discharge hole 205 may be formed at the lower case 202. A support frame 26 may be formed on the top of the upper case 201 and one upper end of the agitating assembly 50 may be swingably connected to the support frame 26.

Figure 7:
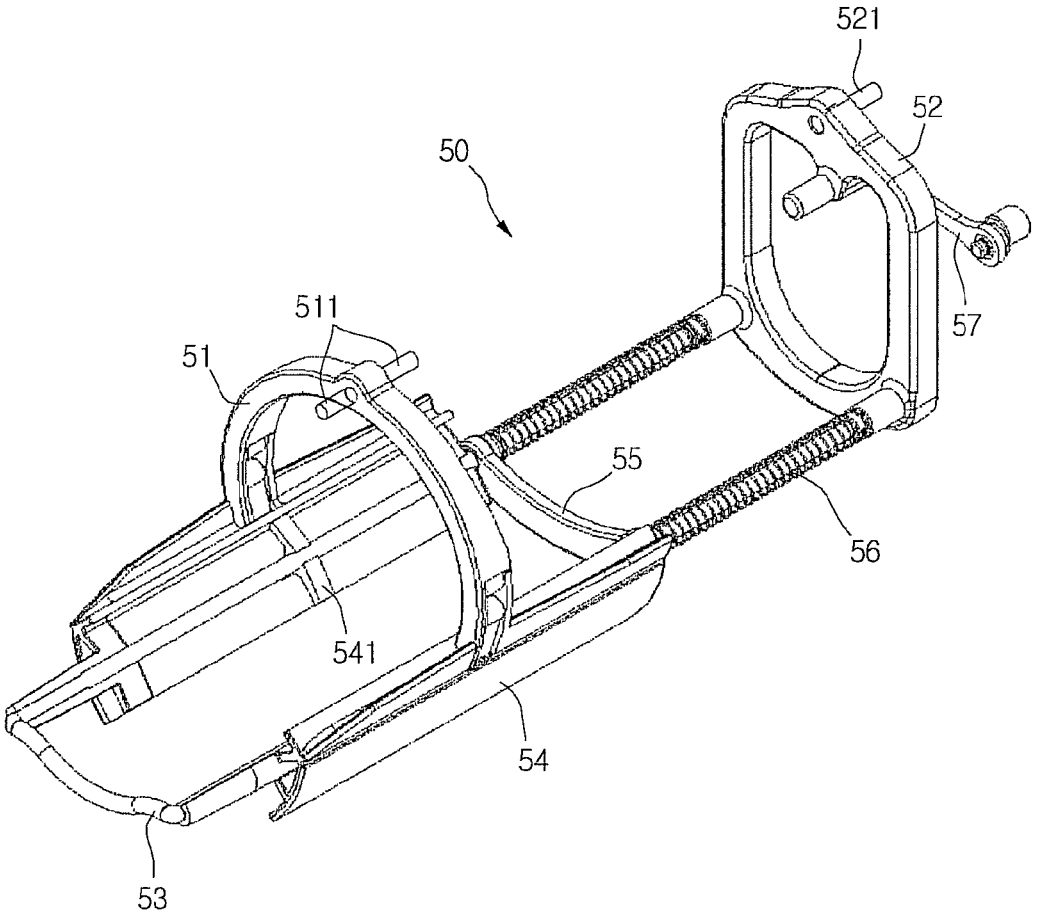
FIG. 7 is a perspective view of an agitating assembly of the cooling device shown in FIGS. 4-6, according to an embodiment as broadly described herein.

FIG. 7 is a perspective view of an agitating assembly of cooling device, according to an embodiment as broadly described herein.

Referring to FIG. 7, the agitating assembly 50 may include a container seat 53 where a container may be received, a first supporter 51 extending from substantially the center of the container seat 53, and a second supporter 52 extending upward from the rear end of the container seat 53.

In detail, a container, for example, a can drink or a wine bottle or other such container, may be mounted on the container seat 53. The present embodiment exemplifies that a pair of bars may be arranged in parallel at a predetermined distance so that the cold air supplied through the intake grill 23 hits against the surface of a container as much as possible. The gap between the pair of bars may be smaller than the diameter of the container to be received so that the container comes in sufficient contact with the cold air without dropping through the space between the pair of bars.

The first supporter 51 may extend from the container seat 53, in detail, may extend at an arch from the pair of bars so that a container may be inserted inside the arch. The first supporter 51 may extend directly from the container seat 53 or may be combined with the container seat 53, and as shown in the figure, it may be combined with the container seat 53, together with an air guide 54 as one unit.

The air guide 54 may be rounded along outer shape corresponding to a container in order to allow the high-pressure cold air discharged through the intake grill 23 to hit against the surface of the container in the container seat 53 as much as possible. The high-pressure cold air discharged through the air holes of the intake grill 23 may disperse outward after hitting against the container, in which the cold air flows along the inner side of the air guide 54, such that the contact area and time of the cold air with the container increase. Therefore, heat may be rapidly exchanged between the cold air and the contents of the container.

A first shaft 511, which may define a center of swing of the agitating assembly 50, may protrude rearward at the top of the first supporter 51 so that the agitating assembly 50 may swing about the first shaft 511. The first shaft 511 may be inserted through the supporter frame 26. In contrast, a shaft may protrude from the support frame 26 and a hole that receives the shaft may be formed at the top of the first supporter 51.

The second supporter 52 may be arched, similar to the first supporter 51, or may have a polygonal shape. A second shaft 521, substantially the same as the first shaft 511, may protrude at the top of the second supporter 52. The first shaft 511 and the second shaft 521 may be arranged along the same line and together define the rotational axis, or swing axis of the swing of the agitating assembly 50. The second shaft 521 may be rotatably fitted in the rear of the case 20.

One end of a swing link 57 may be connected to the rear of the second supporter 52 and the other end of the swing link 57 may be connected to a driving shaft of the swing motor 40. The swing link 57 may be a power transmission member that transmits power from the swing motor 40 for swinging the agitating assembly 50.

A gap control member 56 may be provided on the pair of bars of the container seat 53 and a neck holder 55 may be mounted at the front of the gap control member 56. In detail, two opposite ends of the neck holder 55 may be respectively inserted in the pair of bars of the container seat 53. Accordingly, the neck holder 55 may move forward/backward along the pair of bars. The gap control member 56 may be, for example, an elastic member such as a spring. The neck holder 55 may support an end portion of a can or the neck of a bottle such as a wine bottle, may move forward/backward in accordance with the number of can drinks or the length of a wine bottle received at the container seat 53. For example, when two can drinks are put into the cooling device 10, the neck holder 55 may be pushed back to support the rear ends of the cans, in which the gap control members 56 contract. Alternatively, when a wine bottle is put into the cooling device 10, the neck holder 55 may be adjusted in position to fit the neck of the wine bottle.

Figure 8:
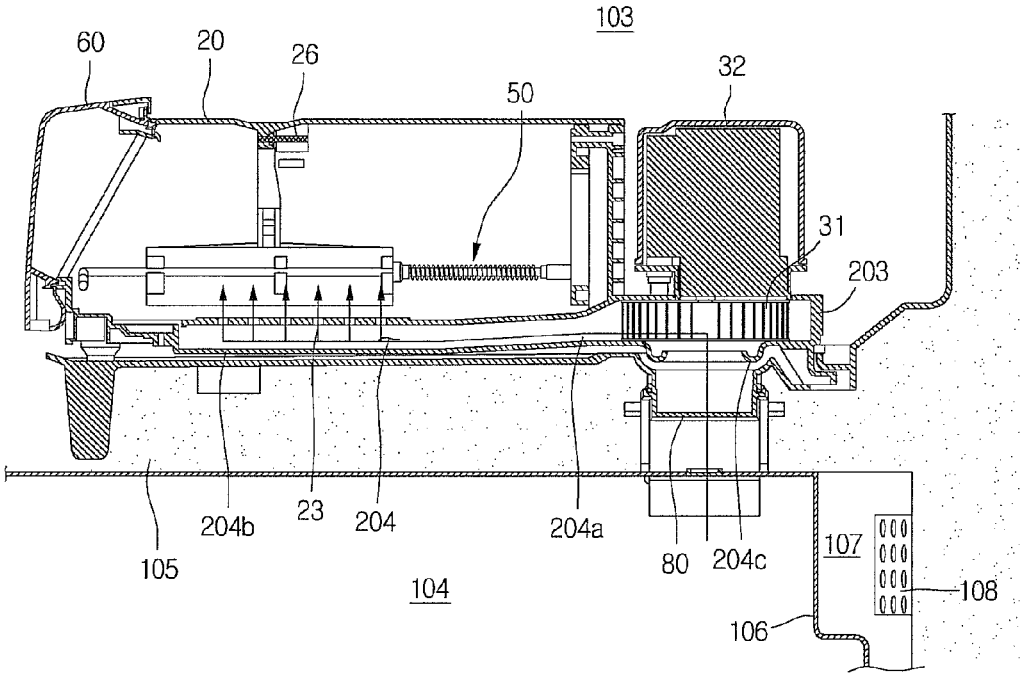
FIG. 8 is a vertical cross-sectional view taken along line I-I of FIG. 4.
Figure 9:
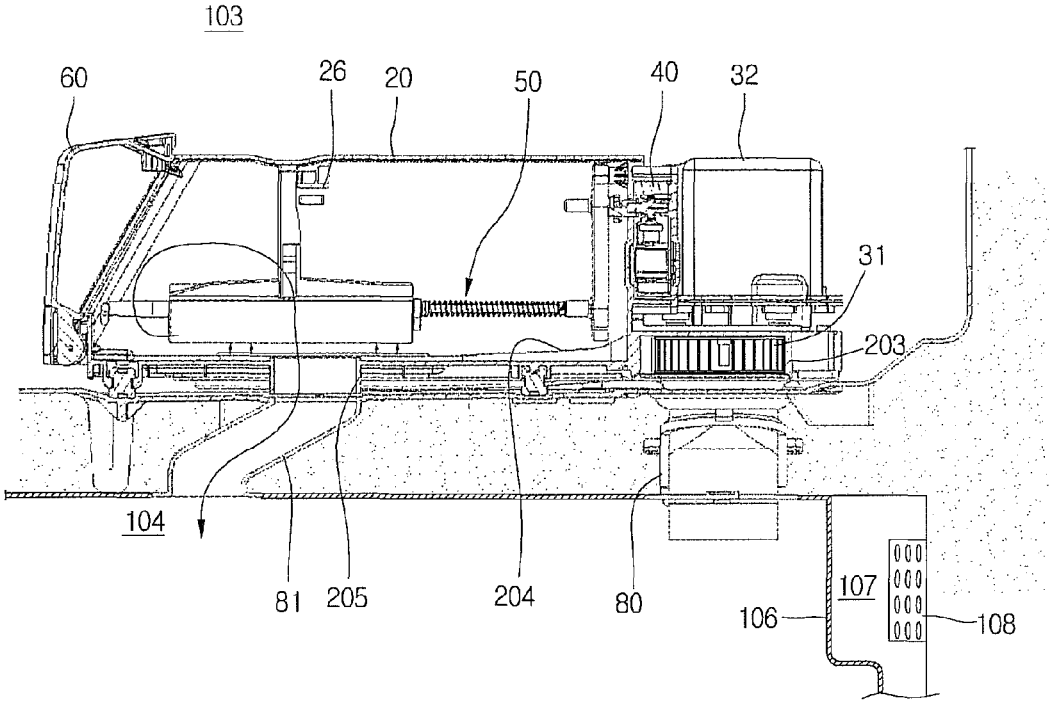
FIG. 9 is a vertical cross-sectional view taken along line II-II of FIG. 4.

FIG. 8 is a vertical cross-sectional view taken along line I-I of FIG. 4 and FIG. 9 is a vertical cross-sectional view taken along line II-II.

Referring to FIG. 8, the cooling device 10 may be mounted on the bottom of the refrigerator compartment 103/top of the separation wall 105 so that the intake duct 80 communicates with the freezer compartment 104 through the separation wall 105. The intake duct 80 may communicate with the shroud 204*c* of the guide cover 204*a*. The fan 31 may be a centrifugal fan or a turbo fan that suctions air axially and discharges air radially. The fan 31 may face the bottom of the refrigerator compartment 103. The cold air supply passage 204 may extend forward at a predetermined length from the rear end of the bottom of the case 20 and the intake grill may be disposed at the portion where a container is to be seated.

Referring to FIG. 9, the discharge port 205 may extend downward at a predetermined length from a side of the cold air supply passage 204. The discharge port 205 may be connected with a return duct 81, which communicates with the freezer compartment 104 through the separation wall 105. Accordingly, cold air in the freezer compartment may be introduced to the fan 31 through the intake duct 80, discharged in the radial direction of the fan 31, and guided to the cold air supply passage 204. The cold air guided to the cold air supply passage 204 may be ejected at a high pressure through the intake grill 23 and hits against the surface of a container seated in the agitating assembly 50. The cold air hitting against the container may be guided to the return duct 81 through the discharge port 205 and then return to the freezer compartment 104. That is, a cold air circulation channel through which the cold air in the freezer compartment 104 returns to the freezer compartment 104 after passing through the cooling device 10 may be formed.

The fan 31 and the swing motor 40 remain non-operational when the cooling device 10 is not operated. In this case, even if the freezer compartment fan operates and a freezer compartment cooling operation is performed, the cold air in the freezer compartment 104 does not flow into the cooling device 10 because the internal pressures of the freezer compartment 104 and the cooling device 10 are the same.

Further, unlike a suction type cooling device in which cold air in the cooling device is introduced and discharged to the freezer compartment, and the cold air in the evaporation chamber flows into the cooling device at negative pressure, the cooling device 10 as embodied and broadly described herein includes a blower type cooling structure that blows cold air in the freezer compartment 104 into the cooling device 10 so that the cold air in the cooling device 10 is pushed back to the freezer compartment 104.

In other cooling devices, an intake duct would have to extend all the way to the intake grill of the cooling device and the intake duct would have to extend along the ceiling of the freezer compartment and then be connected to the bottom of the cooling device through the separation wall, such that the volume of the cold air channel would be relatively large. However, in a refrigerator and cooling device as embodied and broadly described herein, since the intake duct 80 extends to the fan 31 through the separation wall 105 from the rear of the freezer compartment 104, the length of the intake duct 80 is relatively decreased, thereby improving the structure. Further, since the cold air supply passage continuing from the fan 31 to the intake grill 23 extends through the space between the case 20 and the bottom of the refrigerator compartment 103, without passing through the separation wall 105, the duct structure is improved and more compact. That is, the channel corresponding to the intake duct does not need to extend along the ceiling of the freezer compartment 104 and the separation wall 105, such that thermal insulation may be improved.

A refrigerator is provided, including a compact cooling device having an improved cold air supply passage structure and cooling fan structure.

A refrigerator equipped with a cooling device is provided which may prevent condensation around a ceiling of a freezer compartment, including a cold air duct that is not exposed to the freezer compartment.

A refrigerator equipped with a cooling device is provided which may prevent cold air in a freezer compartment from flowing into the cooling device while the cooling device is not in operation without the use of a separate damper.

A refrigerator according to an embodiment as broadly described herein may include a body including a refrigerator compartment and a freezer compartment under the refrigerator compartment; a cooling device mounted on a bottom of the refrigerator compartment; and a cold air passage part guiding cold air to the cooling device, wherein the cooling device includes: a case of which a front surface is open; an agitating assembly disposed in the case and swinging about a rotational axis that is parallel with a length direction of the case; an agitating mechanism electrically or mechanically connected with the agitating assembly and causing the agitating assembly to swing; a fan motor assembly mounted at a rear end of the case and supplying cold air into the case; and a cover selectively opening or closing the opened front surface of the case, wherein an intake port and a discharge port of the cold air passage part communicate with the freezer compartment.

In a refrigerator as embodied and broadly described herein since the cold air intake port and discharge port of the cooling device all communicate with the freezer compartment, pressure between the cooling device and the freezer compartment may remain balanced without the use of a separate damper. Therefore, cold air in the freezer compartment does not flow into the cooling device with the cooling device stopped.

Further, an improved cold air duct structure may allow for a more compact cooling device.

Additionally, since the cold air duct connected to the cooling device is not exposed in the freezer compartment, condensation on the ceiling of the freezer compartment may be avoided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a refrigerator compartment;

a freezer compartment positioned below the refrigerator compartment;

a separation wall partitioning the refrigerator compartment and the freezer compartment; and a cooling device provided in the refrigerator compartment, wherein the cooling device includes:

a case provided on the separation wall and haying an open front surface;

a cover coupled to the case to selectively open or close the open front surface of the case;

an agitating mechanism provided in the case to receive and swing a container about a swing axis that extends horizontally in a front-to-rear direction of the case;

a driving mechanism to swing the agitating mechanism about the swing axis;

an intake grill coupled to a bottom of the case, arranged below the agitating mechanism, and having a plurality of air holes;

a fan to blow cold air from the freezing compartment towards the intake grill, a rotational axis of the fan being vertically oriented;

a fan housing formed at a bottom of a rear end of the case and receiving the fan;

a cold air supply passage extending from the fan housing to the intake grill, wherein the cold air supply passage is integrally formed with the bottom of the case to be positioned above the separation wall;

an intake duct extending from a suction part of the fan housing towards the freezer compartment to allow the fan to intake cold air from the freezer compartment; and a return duct having a first end that communicates with a discharge port formed at the bottom of the case and a second end that communicates with the freezer compartment, wherein the discharge port is formed below the agitating assembly at a position that is spaced apart from the intake grille in a widthwise direction of the case.

2. The refrigerator of claim 1, further including a motor to drive the fan, wherein the fan is a centrifugal fan or a turbo fan that suctions air axially in from the freezer compartment and discharges air radially out into the cold air supply passage.

3. The refrigerator of claim 1, wherein the driving mechanism includes:

swing motor; and a swing link connecting a rotational shaft of the swing motor and an end of the agitating assembly.

4. The refrigerator of claim 1, wherein the agitating mechanism includes:

a container seat including a pair of bars which are arranged in parallel at a predetermined distance away from each other to receive the container;

a first support frame of which both ends are respectively connected to the pair of bars, the first support frame arranged at a position that is apart from proximal ends of the pair of bars;

a pair of gap control springs provided on outer surfaces of each of the pair of bars;

a neck holder of which both ends are penetrated by the pair of bars, the neck holder configured to move back and forth along the pair of bars by an elastic force of the pair of gap control springs according to a length of the container;

a second support frame of which both ends are respectively connected to distal ends of the pair of bars;

a first shaft that rotatably couples a top of the first support frame to a third support frame installed at a top of the case; and a second shaft that rotatably couples a top of the second support frame to the rear end of the case.

5. The refrigerator of claim 1, wherein the intake duct and the return duct are formed to pass through the separation wall.

* * * * *